US007641482B2

(12) United States Patent
Zhong

(10) Patent No.: US 7,641,482 B2
(45) Date of Patent: Jan. 5, 2010

(54) ELECTRICAL CONNECTOR HAVING CONTACTS WITH IMPROVED RETAINING PORTIONS

(75) Inventor: Shu Zhong, ShenZhen (CN)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 12/284,297

(22) Filed: Sep. 18, 2008

(65) Prior Publication Data

US 2009/0075531 A1 Mar. 19, 2009

(30) Foreign Application Priority Data

Sep. 18, 2007 (CN) ..... 2007 2 0046655 U

(51) Int. Cl.
*H01R 12/00* (2006.01)

(52) U.S. Cl. ..... 439/71; 439/940

(58) Field of Classification Search ..... 439/940, 439/71, 733.1, 331, 342, 500
See application file for complete search history.

(56) References Cited

U.S. PATENT DOCUMENTS 4,938,714 A * 7/1990 Kawai et al. ..... 439/607
5,879,169 A * 3/1999 Wu ..... 439/74
5,984,693 A * 11/1999 McHugh et al. ..... 439/66
6,206,732 B1 * 3/2001 Fukuda ..... 439/630
6,296,495 B1 * 10/2001 Wang et al. ..... 439/71
6,416,337 B1 * 7/2002 Fan ..... 439/135
6,626,683 B2 * 9/2003 Lai ..... 439/73
6,786,738 B2 * 9/2004 Lin ..... 439/71
6,981,881 B2 * 1/2006 Adachi et al. ..... 439/71
7,207,821 B1 * 4/2007 Ju ..... 439/331
7,309,238 B2 * 12/2007 Yang ..... 439/71
7,364,467 B2 * 4/2008 Chen et al. ..... 439/633
7,377,789 B1 * 5/2008 Liu ..... 439/66
7,435,103 B2 * 10/2008 Ma ..... 439/71
7,435,145 B2 * 10/2008 Nishio et al. ..... 439/862
2004/0023529 A1 * 2/2004 Howell et al. ..... 439/71
2004/0166703 A1 * 8/2004 McHugh et al. ..... 439/71
2005/0037641 A1 * 2/2005 Chen et al. ..... 439/71
2005/0239302 A1 * 10/2005 Wada ..... 439/71

* cited by examiner

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

An electrical connector includes an insulating housing having a longitudinal and a lateral wall defining a top face and at least one contact. The lateral wall defines a slot thereon. The contact includes a main body located one the top face of the lateral wall and a contacting arm located above the longitudinal wall, a connecting portion extending from an inner edge of the main body and a retaining portion extending from an outer edge of the main body. The retaining portion is retained and received in the slot. A pressed portion laterally extends from the main body.

9 Claims, 4 Drawing Sheets

ELECTRICAL CONNECTOR HAVING CONTACTS WITH IMPROVED RETAINING PORTIONS

BACKGROUND OF THE INVENTION

1. Field of the invention

The present invention relates to an electrical connector with contacts on a top surface of an insulating housing.

2. Description of Related Art

As FIG. 1 shown, a conventional electrical connector includes an insulating housing 1' and two contacts 2'. The housing is a rectangular frame. The contact in an L-like shape includes a main body 21' located on a top face of a lateral sidewall of the housing after the contact is assembled on the housing in a top to down direction, wherein two retaining portion 26' extending from an outer edge of the main body is inserted into and retained in corresponding slots 10' defined in the lateral sidewall. The retaining portion bents from the main body by a curved transition portion 25'. A resilient contacting portion 22' is perpendicular to the main body and upwardly-slantwise located above a longitudinal sidewall to mating with a speaker component. An abutting portion 23' on another end of the main body opposite to the contacting portion abuts against the stop face 11' on another longitudinal sidewall, thereby the contacts is stopped in the longitudinal direction. A soldering portion 24' adjacent to the contacting portion extends downwards from the main body. The contacts are assembled to the housing by an automatic machine.

Due to continuing trend toward miniaturization and improved performance by the electronics industry, the housing and the contact become smaller. However, accurate position of the contacts to the slots and the automatic machine to the contact is difficult when assembling of the contacts, thereby forming a loose assembly of the contact and the housing.

Therefore, an improved electrical connector is desired to overcome the disadvantages of the prior arts.

SUMMARY OF THE INVENTION

An object of the present invention is to provide an electrical connector with a contact, the contact is easily and fitly assembled in an insulating housing of the electrical connector.

In order to achieve above-mentioned object, an electrical connector comprises an insulating housing comprising a longitudinal and a lateral wall defining a top face and at least one contact. The lateral wall defines a slot thereon. The contact comprises a main body located one the top face of the lateral wall and a contacting arm located above the longitudinal wall, a connecting portion extending from an inner edge of the main body and a retaining portion extending from an outer edge of the main body. The retaining portion is retained and received in the slot. A pressed portion laterally extends from the main body.

Other objects, advantages and novel features of the present invention will become more apparent from the following detailed description of the present embodiment when taken in conjunction with the accompanying drawings.

DETAILED DESCRIPTION OF THE INVENTION

Figure 1:
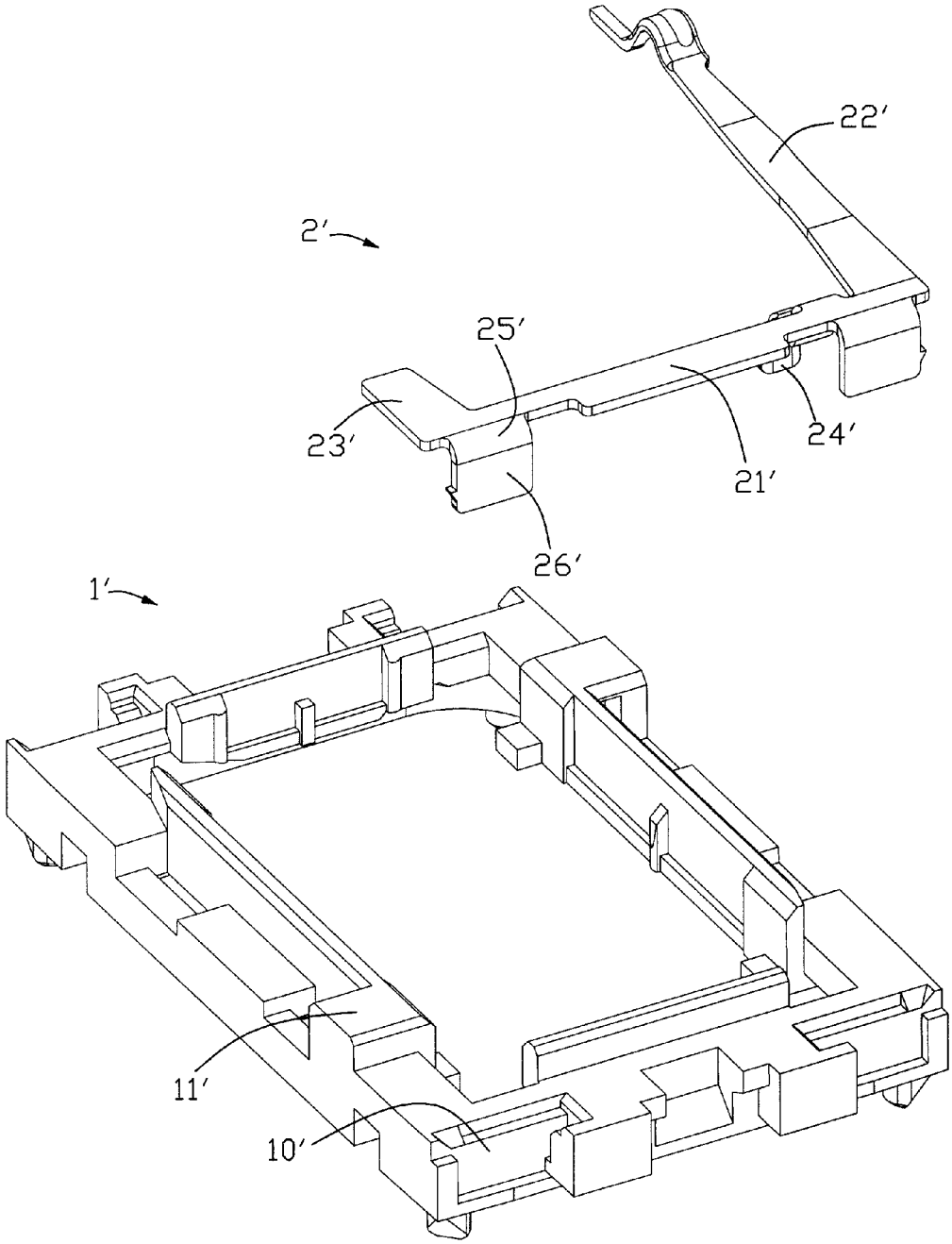
FIG. 1 (PRIOR ART)
FIG. 1 is an exploded view of a conventional electrical connector.

Reference will now be made to the drawing figures to describe a preferred embodiment of the present invention in detail.

Figure 2:
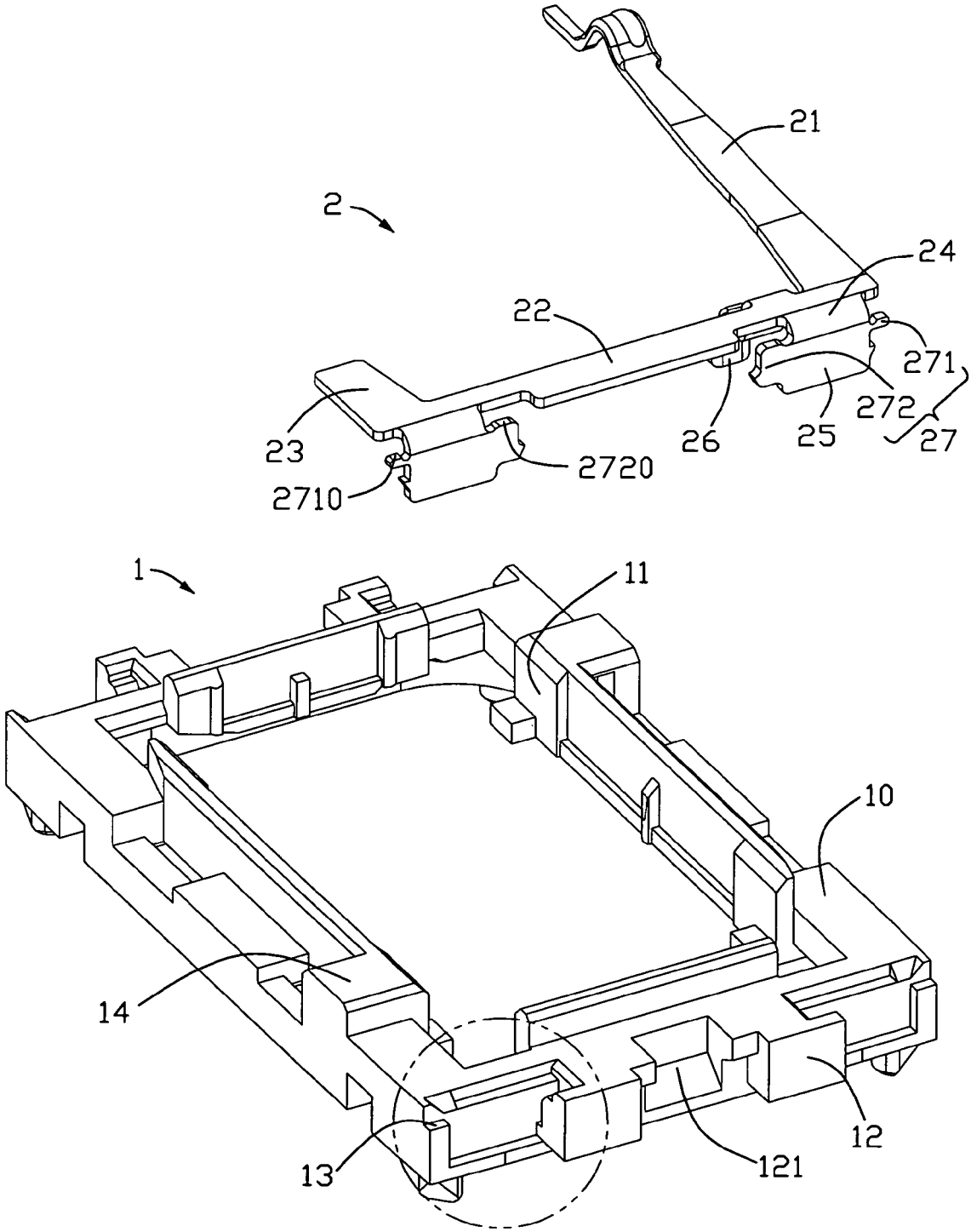
FIG. 2 is an exploded view of an electrical connector embodying the present invention.
Figure 4:
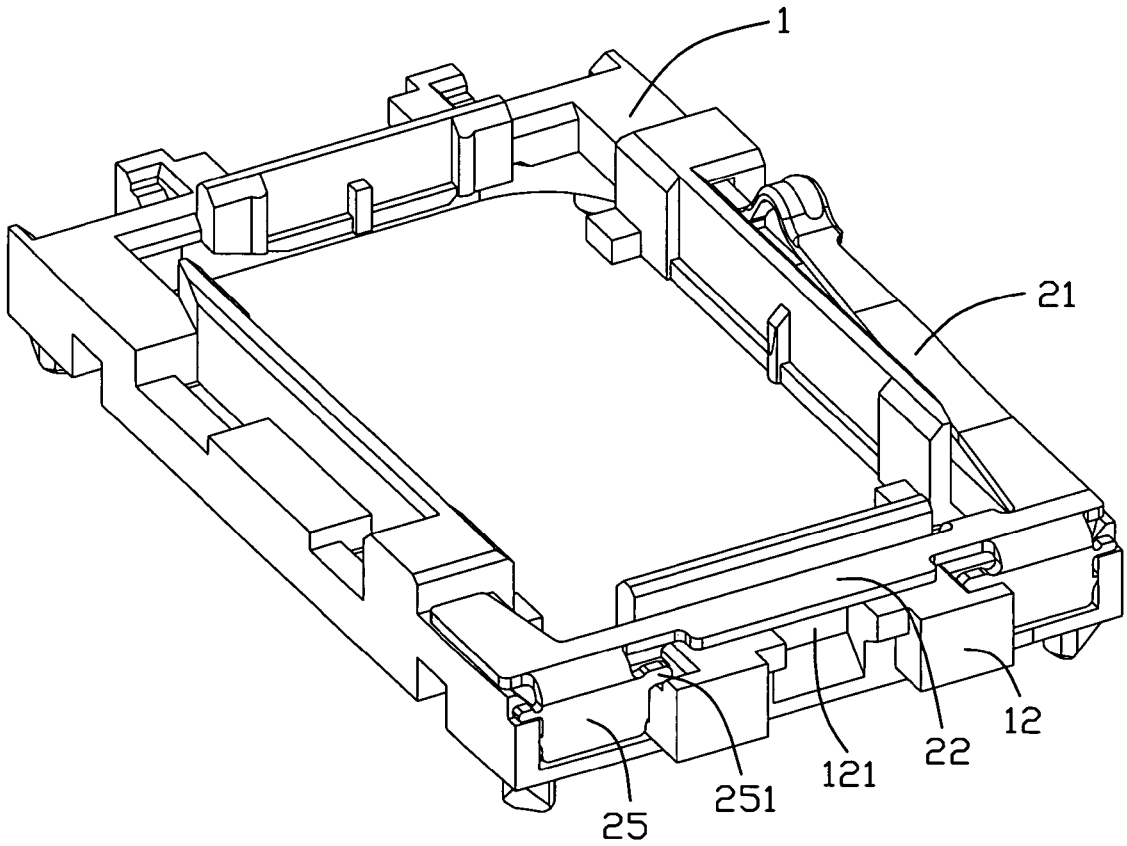
FIG. 4 is an exploded view of an electrical connector of FIG. 2.

Referring to FIGS. 2 and 4, an electrical connector embodying the present invention includes an insulating housing 1 and two contacts 2 (only one is shown in the figures and the two contacts are symmetrical). The housing is a rectangular frame with two parallel longitudinal walls 11 and two lateral walls 12 each having a top face 10. The contact 2 in an L-like shape includes a main body 22 located on a top face 10 of the lateral sidewall 12 of the housing after the contact 2 is assembled on the housing in a top-to-down direction. A cantilevered resilient contacting arm 21 extending perpendicular from one end of the main body 22, is located above the top face of the longitudinal wall 11 of the housing in an free end upward slant pattern. An abutting portion 23 extending from another end opposite to said one end of the main body 22, is located on the top face of another longitudinal wall. The abutting portion 23 abuts against a step portion 14 integrally defined on the longitudinal wall 12, which will further stop the contact from forward moving along the longitudinal wall. Two retaining portion 25 adjacent two ends of the main body 22 and bending from opposite edges opposite to where the contacting arm 21 extending, are retained in two corresponding slots 13 defined in the lateral wall 12. The retaining portion 25 is mechanically connecting with the main body by a curved transition portion 24. A connecting portion 26 extends downward from the inner edge of the main body for being soldered with a electronic wire.

Figure 3:
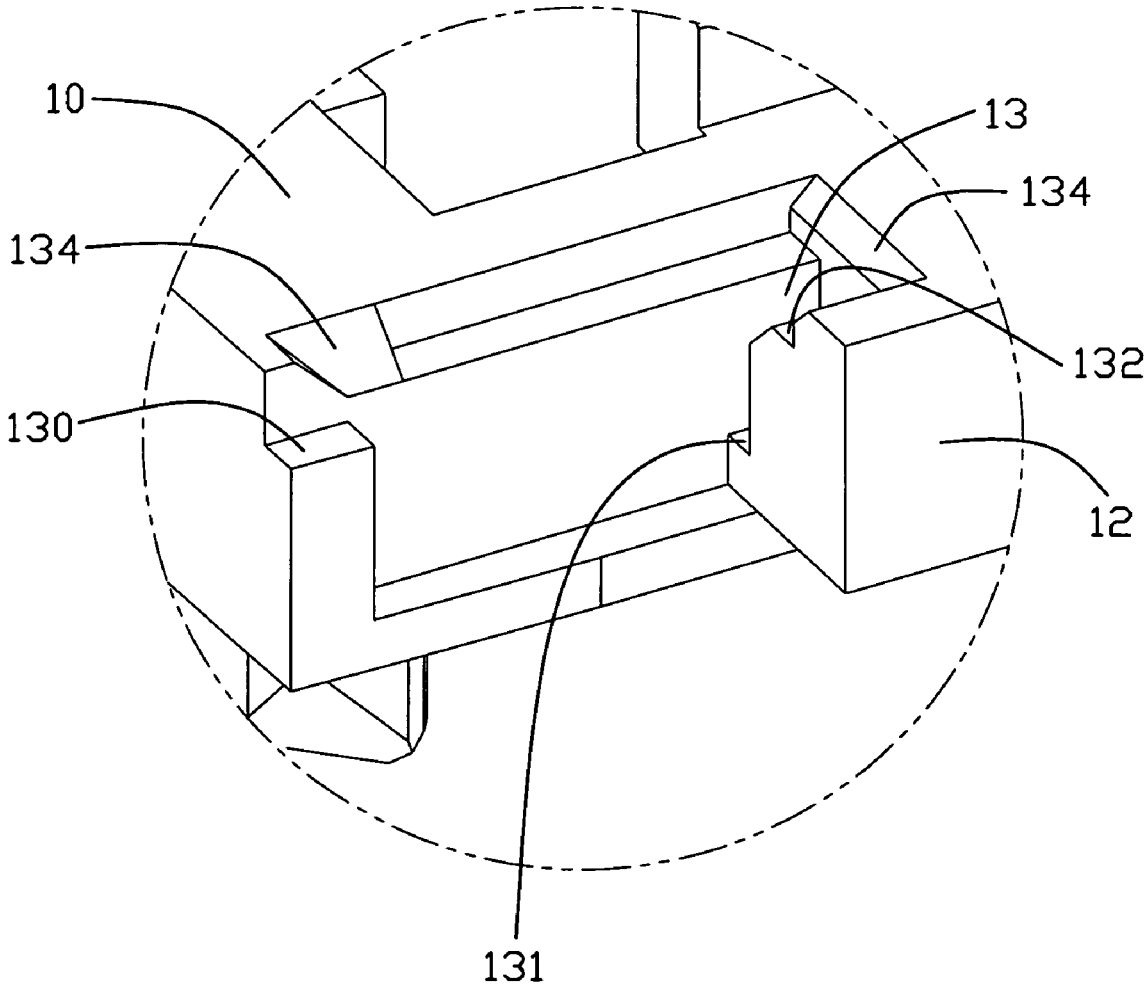
FIG. 3 is a detailed view of an enlarged portion of FIG. 1 by the dashed box.

As best shown in FIG. 3, the slot 13 opens upward and outwards to communicate an exterior. One inner face adjacent to one end of the slot defines step portions forming a lower face 131 and an upper face 132 both facing upwardly. Another end defines a top face 130. Two downward slant guiding faces 134 are formed in an inner side of the slot from the top face 10 of the housing. Referring to FIG. 2, a first pressed portion 271 parallel projects outward from an outer lateral edge of the retaining portion 25 and a second pressed portion 272 parallel projects outward from an inner lateral edge of the retaining portion 25, two adjacent second pressed portions 272 facing to each other. The tops of the two pressed portions are on a same lever while the bottom of the first pressed portion is higher than the second portion, in other word, the second portion is wider than the first pressed portion.

During assembly the contact 2 to the slot 13, the automotive machine clip the pressed portion 27 including the first and second pressed portions 271, 272 to the slot 13, and then press against the top faces 2710, 2720 of pressed portions while a supporting tool goes through a passageway 121 defined in the middle of the lateral wall to upwards support on the main body of the contact, thereby retaining the contact in the slot 13. The second pressed portion 272 abuts against the lower face 131 and the first pressed portion 271 abuts against the top face 130. The upper face 132 leaves a predetermined room for the automotive machine.

However, the disclosure is illustrative only, changes may be made in detail, especially in matter of shape, size, and arrangement of parts within the principles of the invention.

What is claimed is:

1. An electrical connector comprising:

an insulating housing comprising a longitudinal and a lateral wall defining a top face, the lateral wall defining a slot thereon;

at least one contact, each comprising a main body located one the top face of the lateral wall and a contacting arm located above the top of the longitudinal wall, a connecting portion extending from an inner edge of the main body and a retaining portion extending from an outer edge of the main body, the retaining portion being retained and received in the slot; and a pressed portion laterally extending from the main body;

wherein the pressed portion comprises first and second pressed portions respectively projecting from outer and inner lateral edge of the retaining portion;

wherein tops of the first and second pressed portions are on a same lever while a bottom of the first pressed portion is higher than that of the second pressed portion.

2. The electrical connector as described in claim 1, wherein the lateral wall defines a passage going through the top face thereof.

3. The electrical connector as described in claim 1, wherein an abutting portion extends from the main body against a step portion on another longitudinal wall parallel to said longitudinal wall.

4. An electrical connector comprising:

an insulating housing defining a contact locating area;

a retaining slot downwardly in a vertical direction formed in the housing in said contacting locating area; and a conductive contact including a main body with a contacting arm extending on one side, and a retention portion downwardly extending from another side of the main body via a curved transition section; wherein said retention portion is a tab being wider than the transition section and having on two lateral side edges a pair of barbs to interfere within the slot, and a pair of pressing portions located above said pair of the barbs and adjacent to the transition section under a condition that said pair of pressing portions face upward to allow a tool to abut thereagainst for evenly and stably pressing the tab downwardly into the slot.

5. The electrical connector as claimed in claim 4, further including a connecting portion opposite to the retention portion so as to cooperate with the retention portion to sandwich the housing therebetween in a horizontal direction perpendicular to said vertical direction.

6. An electrical connector comprising:

an insulating housing defining a contact locating area;

a retaining slot downwardly in a vertical direction formed in the housing in said contacting locating area; and a conductive contact including a main body with a contacting arm and with a retention portion downwardly extending from one side of the main body via a curved transition section; wherein said retention portion is a tab being wider than the transition section and having on two lateral side edges a pair of barbs to interfere within the slot, and a pair of pressing portions located above said pair of the barbs and adjacent to the transition section under a condition that said pair of pressing portions face upward to allow a tool to abut thereagainst for evenly and stably pressing the tab downwardly into the slot.

7. The electrical connector as claimed in claim 6, further including a connecting portion opposite to the retention portion so as to cooperate with the retention portion to sandwich the housing therebetween in a horizontal direction perpendicular to said vertical direction.

8. The electrical connector as claimed in claim 6, wherein said side is an outer side of said main body.

9. The electrical connector as claimed in claim 6, wherein said main body extends horizontally.

* * * * *